US005207418A

United States Patent [19]

Oakes et al.

[11] Patent Number: 5,207,418

[45] Date of Patent: May 4, 1993

[54] LABEL STACKING APPARATUS

[75] Inventors: Johnathan P. Oakes, Winchester; Jeffery B. Brooks; David A. Kearney, both of Keene, all of N.H.

[73] Assignee: Markem Corporation, Keene, N.H.

[21] Appl. No.: 754,022

[22] Filed: Sep. 3, 1991

Related U.S. Application Data

[62] Division of Ser. No. 583,971, Sep. 18, 1990, Pat. No. 5,079,980.

[51] Int. Cl.[5] ..... B65H 31/08; B65H 31/04

[52] U.S. Cl. ..... 271/212; 271/213; 271/223

[58] Field of Search ..... 271/176, 199, 207, 212, 271/213, 217, 223, 258, 209

[56] References Cited

U.S. PATENT DOCUMENTS

| | | | |
|---|---|---|---|
| Re. 13,273 | 7/1911 | Staude | 271/212 |
| 2,963,177 | 12/1960 | Shields | 214/6 |
| 3,212,774 | 10/1965 | Ingalls | 271/212 |
| 3,270,630 | 9/1966 | Frappier et al. | 271/199 X |
| 3,396,966 | 8/1968 | Solheim | 271/86 |
| 3,601,265 | 8/1971 | Shields | 271/212 X |
| 3,692,304 | 9/1972 | de Ridder | 271/75 |
| 3,744,649 | 7/1973 | Ward, Jr. | 214/6 BA |
| 3,866,765 | 2/1975 | Stobb | 214/8.5 SS |
| 3,998,451 | 12/1976 | McInerny | 271/212 |
| 4,034,846 | 7/1977 | Burgis et al. | 271/213 X |
| 4,067,568 | 1/1978 | Irvine | 271/176 |
| 4,285,511 | 8/1981 | Abe | 271/178 |
| 4,317,564 | 3/1982 | Willenbring et al. | 271/223 |
| 4,522,617 | 6/1985 | Mowry | 493/126 |
| 4,949,608 | 8/1990 | Ward et al. | 271/176 X |

*Primary Examiner*—D. Glenn Dayoan
*Assistant Examiner*—Born Milef
*Attorney, Agent, or Firm*—Venable, Baetjer & Howard

[57] ABSTRACT

Methods and apparatus are provided for the accumulation, cutting, and stacking of continuously moving web material such as fabric tape that is to be printed and cut by appropriate processing apparatus into a plurality of discrete labels The method and apparatus provide for the accumulation of the continuously-supplied web between a base and an overlying resilient spring member while other processing steps such as web cutting are being performed on the web. The spring member engages the tape to temporarily suspend its forward advancement while allowing the tape to accumulate between the spring member and the base. The cut labels are stacked in a bottom-fed stacking assembly having a stacker chute that is angled both rearwardly with respect to the machine front and backwardly in the direction of label advancement to permit the removal of previously processed labels during operation of the processing apparatus.

12 Claims, 9 Drawing Sheets

LABEL STACKING APPARATUS

This is a division of application Ser. No. 583,971, filed Sep. 18, 1990 now U.S. Pat. No. 5,079,980.

BACKGROUND OF THE INVENTION

The invention relates generally to the field of material processing, and more particularly to the processing of a continuous supply of material such as a fabric web that is transported for processing at a substantially constant rate of speed.

The processing of material that is continuously supplied to various material processing apparatus presents a number of obstacles that must be overcome if the material is to be processed economically and expediently. These problems are particularly acute in the field of processing continuous webs of material that are continuously delivered to appropriate processing apparatus. The problem that typically arises in these processing systems is that of handling the continuously moving supply of material when the processing step takes a finite interval of time, during which the input of material for processing must be temporarily suspended. In such instances, this problem has typically been addressed by allowing for the introduction of a predetermined length of excess material or slack between the rollers of the material transport apparatus upstream of the material processing apparatus. However, this technique is not universally applicable for the processing of all types of material webs, since the termination of processing of the upstream portion of material results in sudden acceleration of the slack portion of the web. This can result in web slippage or misalignment within the web transport apparatus, or even web breakage. Further problems arise when the material web is to be mechanically worked, as by molding, shaping, or printing, without compromising the structural integrity of the web.

The processing of material in the form of continuous webs is advantageous when the production of a large number of substantially identical articles is to be achieved. Such situations arise, for example, in the manufacture and printing of standard articles such as fabric care labels that are required to be included with, or affixed to, various garments and items of apparel that are to be introduced into the marketplace for sale. As the provision of such fabric care labels is usually a requirement imposed upon the garment or apparel manufacturer rather than one that is voluntarily adopted, as is the case with source identifier labels which display trade names and trademarks in which the manufacturer has invested substantial time and capital, there exists little motivation to provide a fabric care label that exceeds the minimum standards for size, durability and clarity. Further, because the provision of such fabric care labels is not typically associated by the garment manufacturer with generating sales revenue, considerable emphasis is placed on obtaining the required care labels in the most cost effective manner possible. However, efforts to introduce into the market printing machines that are capable of economically and expediently producing large numbers of individually printed labels, and that are readily adaptable to implement changes in the content of the information to be printed or the color, composition or size of the label itself, have not been entirely successful due to the previously described problem of handling a continuous supply of fabric label material to be printed.

In view of the foregoing disadvantages and limitations in the prior art, it is an object of the subject invention to provide methods and apparatus for efficiently and economically handling a continuous supply of material that is to be mechanically worked such as by printing prior to severing into individual, discrete printed articles.

A further object of the subject invention is to provide methods and apparatus which provide for the orderly stacking of continuously supplied articles.

Yet a further object of the invention is to provide methods and apparatus which provide for the cutting of a continuously fed material web into a plurality of web segments and the orderly stacking of the cut web segments in such a manner as to permit the efficient removal of the cut and stacked web segments during the course of web processing.

SUMMARY OF THE INVENTION

The invention provides accumulator, cutting and stacking methods and apparatus for use incident to the processing of a continuously moving supply of material such as fabric tape that is advanced from a supply reel. The invention is particularly advantageous when it is used in combination with a printing apparatus to economically produce large quantities of printed and cut articles such as fabric or other types of labels that are provided with a common message.

In one aspect of the invention, apparatus and methods are provided for accommodating a substantially constant velocity flow of a material web that is to be processed at a downstream position of a web processing device. The apparatus includes a substantially flat base, spring means positioned generally parallel to the base, web drive means for providing a substantially constant velocity flow of web material between the support base and the spring means, and braking means engageable with the web for stopping the flow of the web beyond the support base and overlying spring means. The spring means is displaceable by the web between a rest position and an expanded position. Actuation of the braking means is operable to cause buckling of the tape between the support base and the spring means and displacement of the spring means to the expanded position. Release of the braking means is operable in combination with the expanded spring means to unbuckle the buckled portion of the web and accelerate the web downstream of the support base.

An alternative aspect of the invention relates to stacking apparatus and methods for receiving a plurality of pieces which have been cut from a web of elongate material. A stacking chute is provided for receiving the cut web pieces from a conveyor which carries the web pieces following their cutting from the material web. The stacking chute and conveyor belt are mounted to a mounting plate that is arranged to angle the stacking chute with respect to two of three mutually perpendicular reference axes. Preferably, the stacker chute is angled rearwardly with respect to a front vertical plane and backwardly in the direction of web travel from an entry end of the stacking chute toward an exit end of the chute.

BRIEF DESCRIPTION OF THE DRAWINGS

Further details of the subject invention will become apparent from a reading of the following specification with reference to the accompanying drawings, in which.

DETAILED DESCRIPTION OF THE PREFERRED EMBODIMENTS

Figure 1:
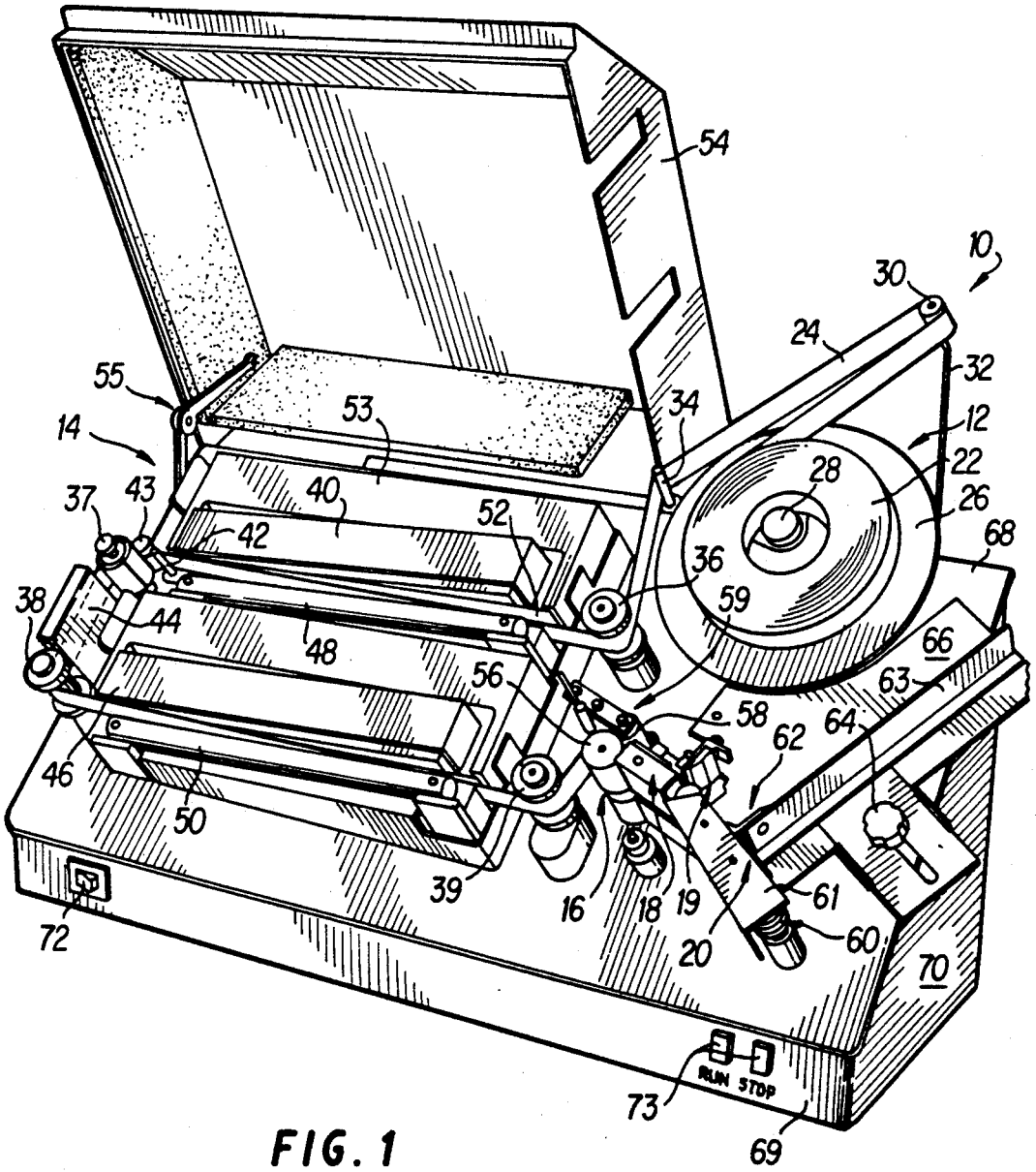
FIG. 1 is a perspective view of a fabric label printing machine in accordance with the subject invention.

With reference to the drawings, wherein like parts are represented by like reference characters throughout the various views, and with particular reference to FIG. 1, there is depicted a web processing apparatus such as a fabric label printer, designated generally by reference numeral 10. The label printer 10 is comprised generally of a fabric tape supply assembly 12, a tape printing assembly 14, a tape drive assembly 16 for advancing fabric tape from the tape supply assembly 12 through the printer, a tape accumulator assembly 18 for accommodating the flow of tape incident to tape cutting, a tape cutting assembly 19, and a stacking assembly 20 for collecting and stacking printed and cut labels that are produced by the label printer. Details of the structural configuration and operation of each of the foregoing assemblies are provided in the following specification.

The tape supply assembly 12 is comprised of a supply reel 22 of fabric tape 24 that is rotatably mounted to a support platter 26 by a retaining knob 28 which overlies a post (not shown) extending transversely outwardly from the support platter. The fabric tape is preferably a printable polyester, acetate, poly-cotton blend, or nylon, and is wound around a roller 30 that is mounted to a pivotable dancer arm 32. Following its passage around the dancer arm roller 30, the tape 24 is threaded behind a guide pin 34 and around a first of four guide posts 36, 37, 38 and 39 to the printer assembly 14.

The printer assembly 14 includes a first printer 40 that is positioned so as to print predetermined information on a front side of the fabric tape. Following passage past the first printer 40, the tape 24 is threaded between guide pins 42 and 43 and around the second guide post 37 and past an optional heater 44 that can be provided for facilitating bonding of the characters printed by the first printer 40 onto the tape. The second guide post 37 is preferably implemented as an encoder roll that generates a signal output indicative of the length of tape 24 that has travelled past its location. Data generated by the encoder roll 37 is used to maintain proper registration between the printers and the tape, as well as to signal when replacement supplies are due to be added to the machine 10. The tape is carried around the third guide post 38 and past the second printer 46 for printing of predetermined information on the back side of the tape. The printers 40 and 46 are preferably of the hammer printer impact type such as the Model 690 printer manufactured by Mannesmann Tally Corp. of Kent, Wash. The image to be printed can be of a type that is computer-generated by suitable software and communicated to the printer by appropriate busses and cables. Anvils 48 and 50 are provided adjacent the respective printers 40 and 46 for receiving printer hammer strikes directed against the ink ribbons 52 carried by ribbon cartridges 53 and the fabric tape. The ink ribbons preferably are provided with a liquid ink that bonds to the tape in a manner that is sufficient to withstand repeated cleaning and drying cycles of the type that are typically encountered during the course of fabric care. An acoustic cover 54 can be provided to absorb some of the noise that is generated during the course of printer operation. The cover 54 is mounted to the machine 10 by a conventional self-locking hinge assembly 55.

Fabric tape exiting the printer assembly 14 is routed around the fourth guide post 39 and past the tape drive assembly 16, which includes a drive roller 56 that rotatably drives the tape 24 from the supply reel 22 toward the stacking assembly 20. A roller 58 of an adjustable tape tensioning unit 59 is provided to establish optimal tension between the drive roller 56 and the fabric tape to permit for the efficient advancement of the tape 24 through the machine 10. As the tape passes around the drive roller 56, it is directed through the accumulator and cutting assemblies 18 and 19 for cutting into fabric care labels having a predetermined length. The cut labels are then transported by a belt conveyor 60 to the label stacking assembly 20. A cover 61 overlying the conveyor 60 can be provided to inhibit the contact of foreign objects such as the hands or clothing of a machine user with the belt conveyor.

The stacking assembly 20 defines a label stacking chute 62 that is generally comprised of a guide plate 63 that is adjustably mounted by a tensioning knob 64 to a chute back cover 66. This allows dimensioning of the chute 62 in accordance with the size of the labels to be received therein. Adjustably positionable sensor means such as optical sensor 67 can be provided along the back cover 66 to provide for the cessation of label production once the cut labels have reached a predetermined position within the stacking chute 62.

All of the foregoing machine components are mounted to a machine mounting plate 68 that is inclined rearwardly with respect to the front 69 of an underlying housing 70. Various control and display apparatus, such as a power control switch 72 and status indicator lights 73, can be provided along the front side of the machine 10 to provide an indication as to the condition of machine operation.

Figure 2:
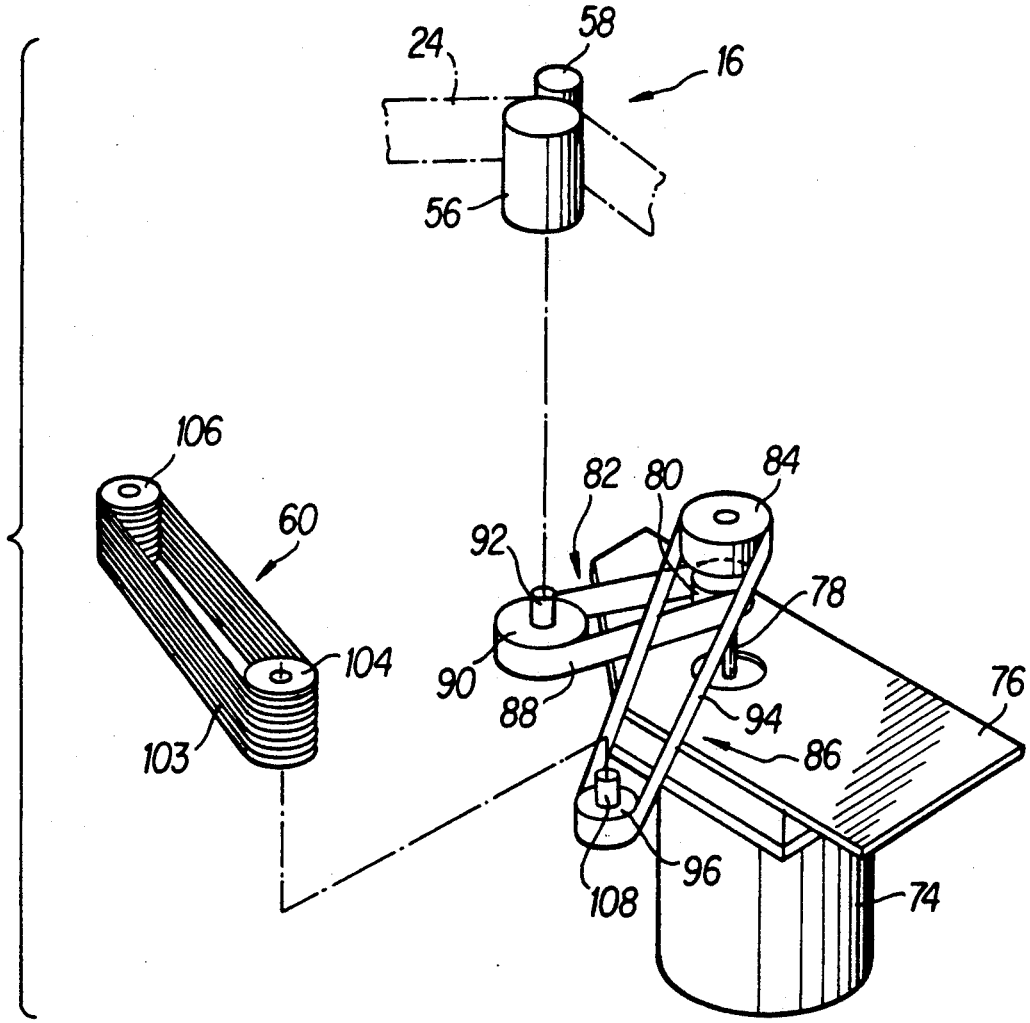
FIG. 2 is a disembodied view of the drive assembly for the apparatus depicted in FIG. 1.

FIG. 2 illustrates the arrangement of drive belts which provide for the transport of fabric tape 24 through the fabric label printer 10. Power for the drive assembly is provided by a suitable electric motor 74 that is secured in place by a motor mount 76. The output shaft 78 of the motor 74 is connected to a pulley 80 of a tape drive system 82 and to a pulley 84 of a stacker drive system 86. The tape drive system is further comprised of a timing belt 88 and pulley 90 which is directly connected to the drive roller 56 through a shaft 92 extending therebetween. The stacker drive system is further comprised of a timing belt 94 and pulley 96, the upper end of which is configured in a conventional manner to receive the belt 94. The stacker belt conveyor 60 includes a belt 103 which extends around rollers 104 and 106. Roller 104 is coupled to primary drive system pulley 96 through shaft 108, whereas roller 106 is mounted to an idler (not shown). While driven components and systems in addition to those described above can be provided for the printer 10, it is to be appreciated that such additional components and systems can be coupled in an appropriate manner to the output shaft 78 of the motor 74 so as to be driven thereby. The foregoing description therefore sets forth the manner by which the power requirements the entire printer 10 can be satisfied through the provision of a single motor acting through appropriate transfer apparatus.

Figure 3:
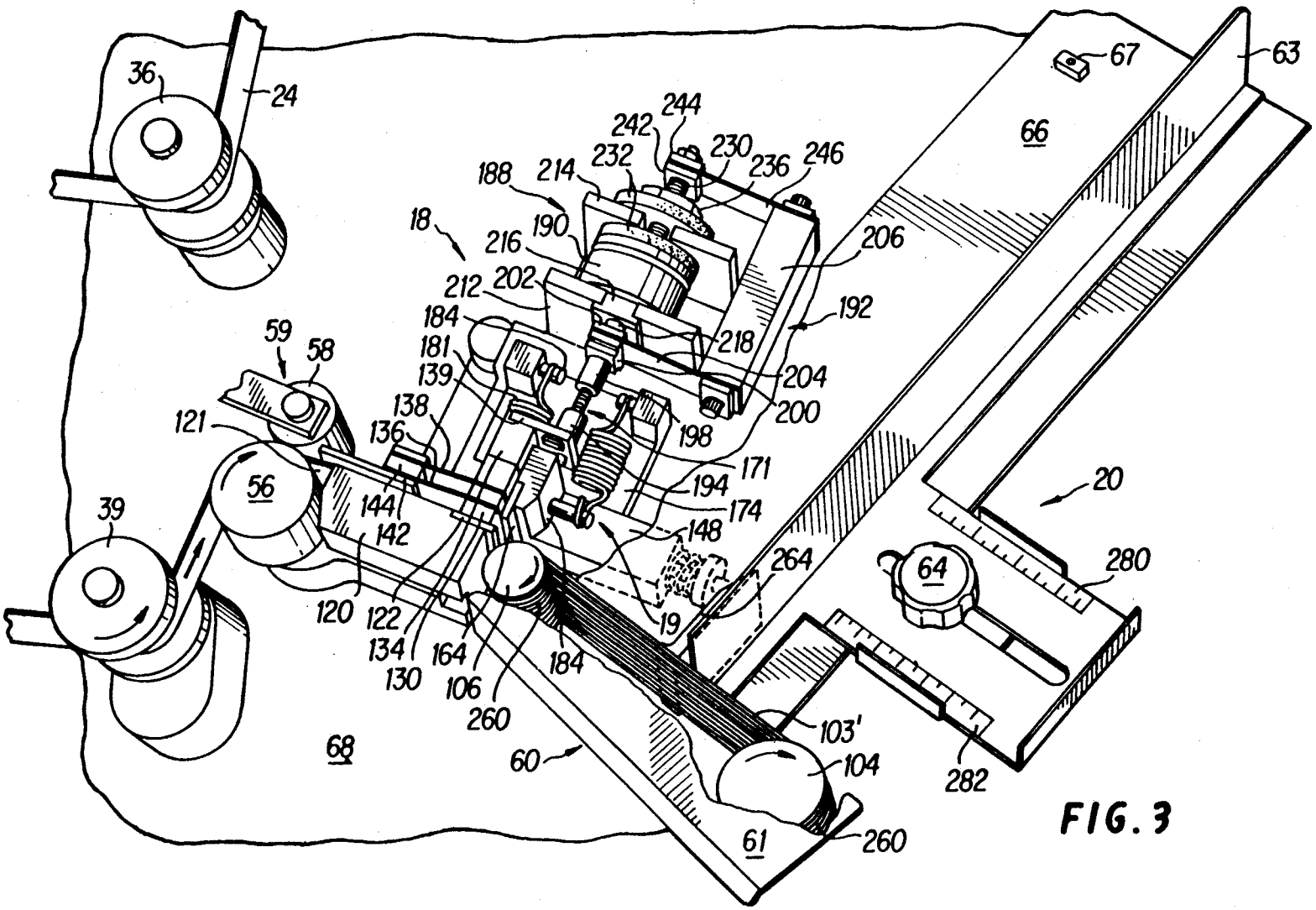
FIG. 3 is a perspective view of the web accumulating, cutting and stacking components of the apparatus of FIG. 1, with the cover portions thereof partially broken away.
Figure 4:
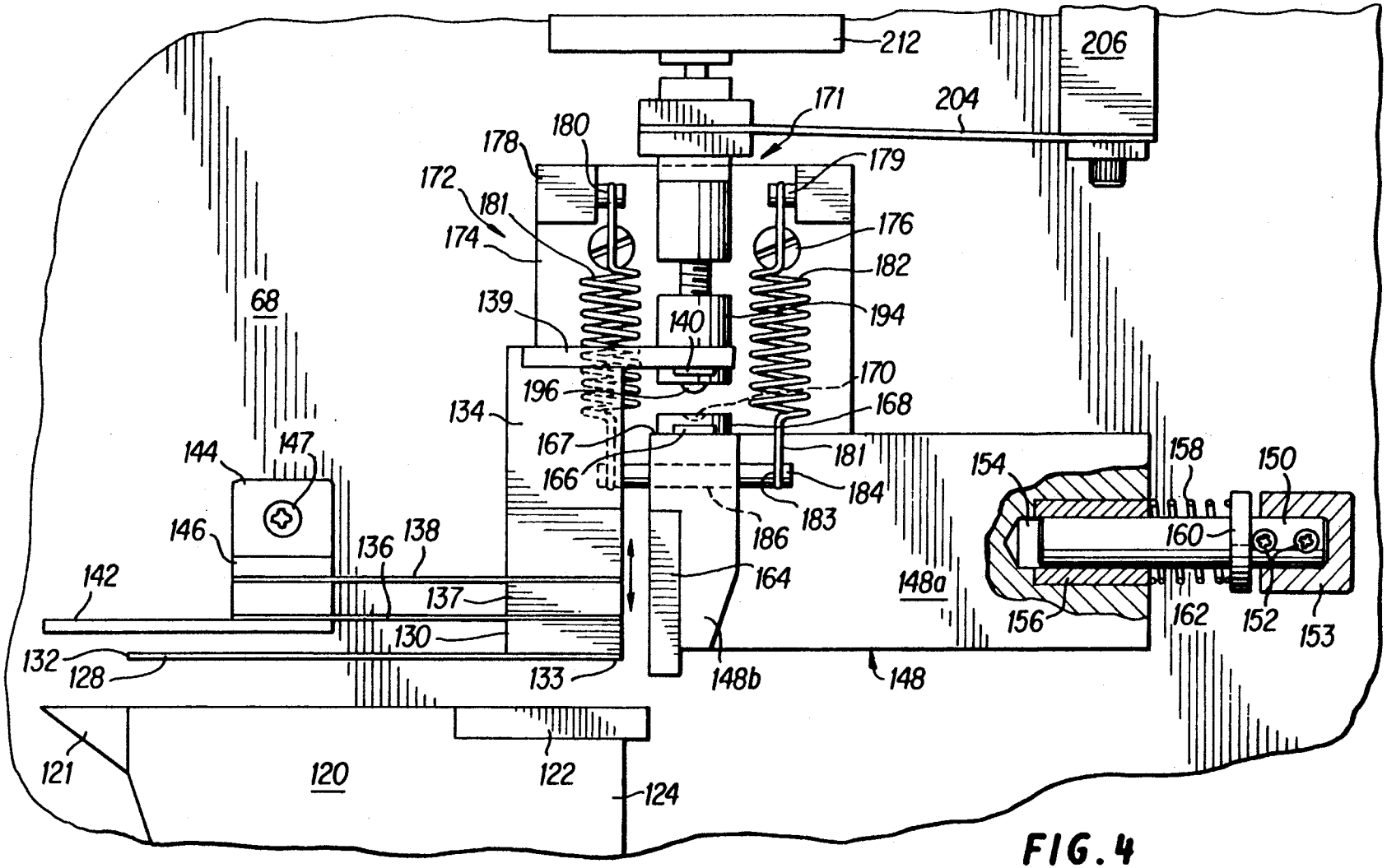
FIG. 4 is a sectional side view of the accumulator and lower portion of the cutting assembly of the subject invention.
Figure 5:
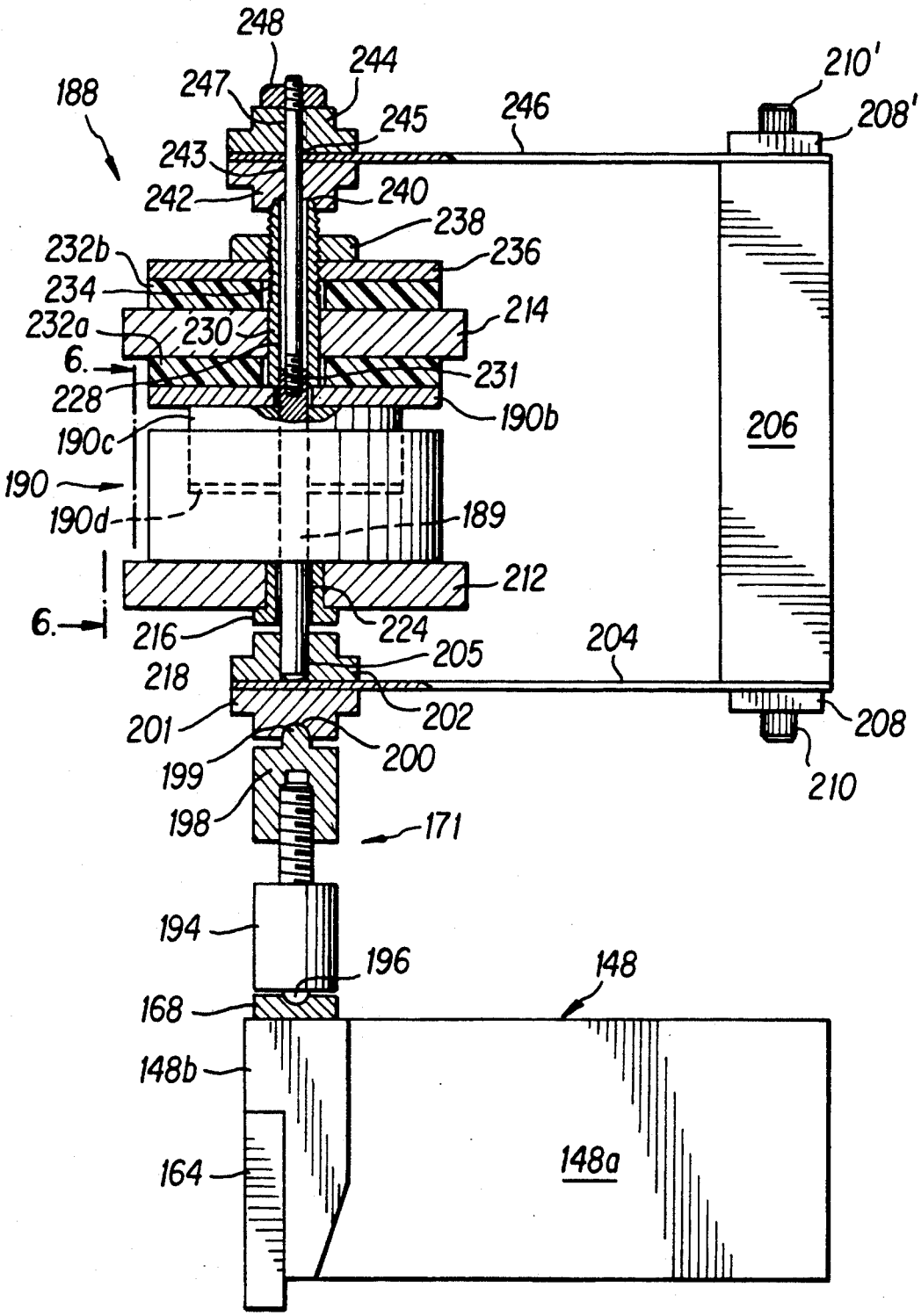
FIG. 5 is a longitudinal sectional view of the solenoid actuator system of the subject invention.
Figure 6:
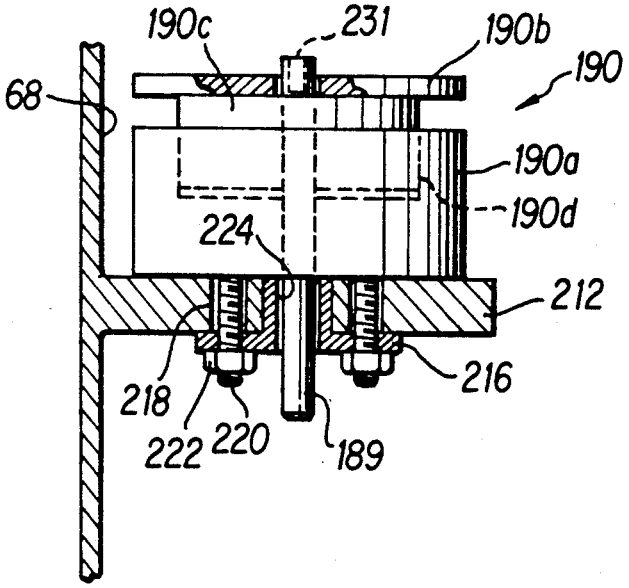
FIG. 6 is a sectional view along the lines 6—6 of FIG. 5.

With reference to FIGS. 3 through 5, there are depicted further details of the accumulator, cutter and stacker assemblies 18, 19 and 20 of the subject invention. Throughout the following description, the description and function of the fabric tape accumulator will be presented in conjunction with that of the fabric tape cutter, as the preferred embodiment of the invention provides for their related operation. However, persons of ordinary skill in the art of web processing will readily appreciate that the functions of the tape accumulator and cutter can be separated from one another so as to render the components independently operable.

As shown in the drawings, the accumulator assembly 18 is positioned downstream of the tape drive roller 56 and includes at its lower end a rigid support base 120 that is fixedly connected to the mounting plate 68. As used throughout this disclosure, the term "downstream"relates to the direction of tape travel through the printer, whereas the term "upstream" refers to a direction opposite that of tape travel. The upstream end of the base 120 is provided with a flange 121 that extends toward the drive and tension rollers 56 and 58, respectively, to facilitate passage of the tape 24 to the support base 120. A generally flat, sharp-edged cutting blade 122 is detachably mounted to the base 120 in a conventional manner. The blade extends beyond the downstream edge 124 of the base 120 and constitutes the lower half of a scissors cutter 126 for cutting the tape 24 into a plurality of sections having a predetermined length. Further details of the scissors cutter 126 are provided below Positioned above the support base 120 in a spaced, generally parallel relation therewith is a label spring 128. The label spring 128 is formed as a thin planar strip of flexible metal that is connected at its downstream end to a rigid spacer bar 130, and terminates at a free upstream end 132. The downstream end 133 of the label spring functions as a tape brake upon downward displacement of the label spring and its associated hardware, described below, to prevent passage of the tape 24 between the brake and the downstream end of the support base 120. The end of the spacer bar 130 opposite to that which is connected to the label spring 128 is coupled by appropriate fastener means such as threaded fasteners to a lifter post 134 through a lower lifter spring 136, spacer bar 137, and upper lifter spring 138. An accumulator lifter arm 139 is mounted by conventional fastening means to the upper end of the lifter post 134 for providing a work surface by which the portion of the accumulator assembly positioned above the support base 120 can be elevated by the cutting assembly 19 away from the support base 120. A replaceable shock and acoustic damper 140 is provided at the cutting assembly contact surface of the lifter arm 139 to absorb the impact and noise associated with contact between the lifter arm and the cutting assembly 19.

The upstream end of the lower lifter spring 136 is connected to a generally rigid hold-down plate 142 which extends outwardly beyond the lifter spring 136 toward the upstream end 132 of the label spring 128. The holddown plate 142 is also connected to the upper lifter spring 140 by appropriate fastening means through a generally L-shaped accumulator mount 144. A clamp 146 secures the upper surface of the upper lifter spring 138 to the mount 144. The accumulator mount 144 is fastened to the machine mounting plate 68 by conventional fastening means such as a threaded fastener 147 so as to be rigidly mounted thereto. The lifter springs 136 and 138 extending from the mount 144 to the lifter post 134 are biased so as to exert a downward force on the tape 24 to urge the upstream end of the label spring 128 toward the support base when the accumulator assembly 18 is in a rest position.

The cutting assembly 19 is positioned adjacent to the downstream end of the accumulator assembly 18 The cutting assembly includes a generally L-shaped cutter arm 148 which is pivotably mounted to the machine mounting plate 68 through a shaft 150. Threaded fasteners 152 secure the downstream end of the shaft 150 to a generally U-shaped recess 153 formed in the mounting plate. The upstream end of the shaft 150 is received within a bore 154 formed in the elongated leg **148*a* of the cutter arm. The bore 154 is provided with a suitable bearing surface 156 to provide for rotational movement of the cutter arm 148 relative to the shaft 150. A spring 158 is interposed between the cutter arm leg 148*a* and a collar 160 that is secured to the shaft 150 by fastening means 162, so as to bias the short leg 148*a* of the cutter arm and the cutter blade 164 carried thereby toward the cutter blade 122 carried by the accumulator support base 120. The cutter blade 164 is preferably detachably mounted to the cutter arm leg 148*b* by conventional fastening means (not shown) so as to permit periodic cutter blade replacement. The cutter blades 122 and 164 are positioned relative to one another such that a portion of the tape 24 (not shown) that is interposed between the respective blades can be severed from the web upon downward rotational displacement of the cutter arm 148 in the manner described below. A threaded bump screw 166 is received within a correspondingly-threaded recess formed in an upper side 167 of the cutter arm 148*b* at a position directionally aligned with the accumulator lifter arm shock damper 140. The bump screw contacts the shock damper upon rotational displacement of the cutter arm 148 away from the support base 120 in the manner described below. Positioned adjacent to the bump screw 166 is an actuator seat plate 168 that is coupled to the cutter arm 148*b* by conventional fastener means (not shown). The seat plate 168 defines a seating surface 170 along an upper side thereof for receiving the lower end of a rod assembly 171 that is actuable in the manner described below to rotatably displace downward the cutter arm 148 and the cutter blade 164 carried thereby about the shaft 150 to effect cutting of the tape 24**.

The resilient force which urges the cutter arm 148 away from the accumulator support base 120, thereby biasing the upper scissor cutter blade 164 toward an open position, is provided by the cutter arm biasing system denoted generally by reference numeral 172 (FIG. 4). The biasing system 172 is comprised of a spring retainer bracket 174 that is detachably mounted by threaded fasteners 176 or other suitable fastening means to the mounting plate 68. The retainer bracket 174 is configured so as to include a pair of opposed, outwardly-extending legs 178. Each of the legs 178 is provided with an inwardly-extending flange 179 having a recess 180 formed therein for receiving one of the turned ends 181 of an extension spring 182. The opposite turned end 181 of each spring 182 is received within an appropriately dimensioned and configured channel 183 formed in opposite ends of a drive pin 184 which extends through a transverse aperture 186 formed in the cutter arm leg 148*b*. The biasing system is therefore operable to bias the cutter arm 148 and scissors cutter blade 164 carried thereby toward a rotationally elevated position away from the accumulator support base 120 in the absence of a countervailing force exerted through the rod assembly 171 that is of sufficient magnitude to overcome the spring force exerted by the springs 182.

A solenoid system, designated by reference numeral 188, is selectively operable to produce a downward force which is sufficient to overcome the retentive force exerted by the cutter arm biasing system 172 to effect braking of the tape between the label spring 128 and the support base 120 and the downward movement of the cutter arm 148 to cut the tape 24. With particular reference to FIGS. 3 through 6, the solenoid system 188 is generally comprised of the above-mentioned rod assembly 171 that is coupled to the shaft 189 of a solenoid 190 through a solenoid spring system 192. The solenoid itself is comprised of an armature 190*a* and a disc 190*b* that is connected to the shaft 189 and is displaceable relative to the armature 190*a* upon longitudinal movement of the shaft 189 within the solenoid armature 190*a*. The magnetic mass of the disc 190*b* is preferably augmented by the addition of a metallic slug 190*c* along the lower surface thereof. The slug 190*c* is received within a complementarily-dimensioned channel 190*d* formed in the solenoid armature 190*a*. The rod assembly 171 comprises a threaded shaft 194 having a rounded lower end 196 that is configured to be complementary to the seating surface 170 of the seat plate 168 and a spacer 198 having correspondingly-threaded recess formed therein for receiving the shaft 194. The length of the rod assembly can be varied by rotatably adjusting the position of the shaft 194 relative to the spacer 198. The end 199 of the spacer 198 opposite that which receives the threaded shaft 194 frictionally engages a complementarily-configured recess 200 of a rod seat 201 that is coupled to a clamp 202 through an end of a lower solenoid spring 204. The clamp 202 defines an aperture 205 through which the lower end of the solenoid shaft 189 extends to abut against the solenoid spring 204. The opposite end of the solenoid spring 204 is coupled to a spring block 206 by an alignment block 208 that is adjustably mountable thereto by a threaded fastener 210.

The solenoid 190 is mounted between lower and upper generally U-shaped brackets 212 and 214 that are formed integrally with the mounting plate 68. An alignment block 216 is insertable in the slot opening of the lower bracket 212 for securing a lower end of the solenoid 190 in position adjacent to the bracket 212. The alignment block 216 is provided with a pair of apertures 218 that are dimensioned to receive therethrough threaded pins 220 extending from the lower end of the solenoid. Coupling of nut fasteners 222 to the pins 220 securely mounts the solenoid 190 to the lower bracket 212. A central aperture 224 is formed in the alignment block 216 to permit passage therethrough of the solenoid shaft 189.

The upper end of the solenoid shaft extends beyond the solenoid disc 190*b* and into the aperture 228 of an adjustable threaded spacer 230. A threaded aperture 231 is provided in the upper end of the solenoid shaft 189. The spacer 230 extends through the center of cylindrical sound and shock dampers 232*a* and 232*b* positioned adjacent to the lower and upper ends, respectively, of the upper mounting plate bracket 214. The upper, threaded end 234 of the spacer 230 engages the correspondingly-threaded portion of adjustable stop 236 and is secured in position by a threaded nut fastener 238, thereby fixing the position of the solenoid 190 with respect to the upper mounting plate bracket 214. The upper end of the spacer 230 extends through the nut fastener 238 and is received within the seat 240 of a clamp bar 242. The clamp bar 242 is secured to an alignment block 244 through the end of an upper solenoid spring 246 upon coaxial alignment of clamp bar aperture 243, spring aperture 245, and block aperture 247 and extension therethrough of threaded fastener 247. The threaded fastener extends into the complementarily-threaded solenoid shaft recess 231 to secure the upper solenoid spring 246 to the solenoid shaft 189. The opposite end of the solenoid spring 246 is adjustably connected by alignment block 208' and threaded fastener 210' to the spring block 206. The solenoid spring system 192, acting through the lower and upper solenoid springs 204 and 246, maintains the solenoid shaft 189 in a substantially centered position with respect to the solenoid body 190*a* throughout its displacement.

Figure 7:
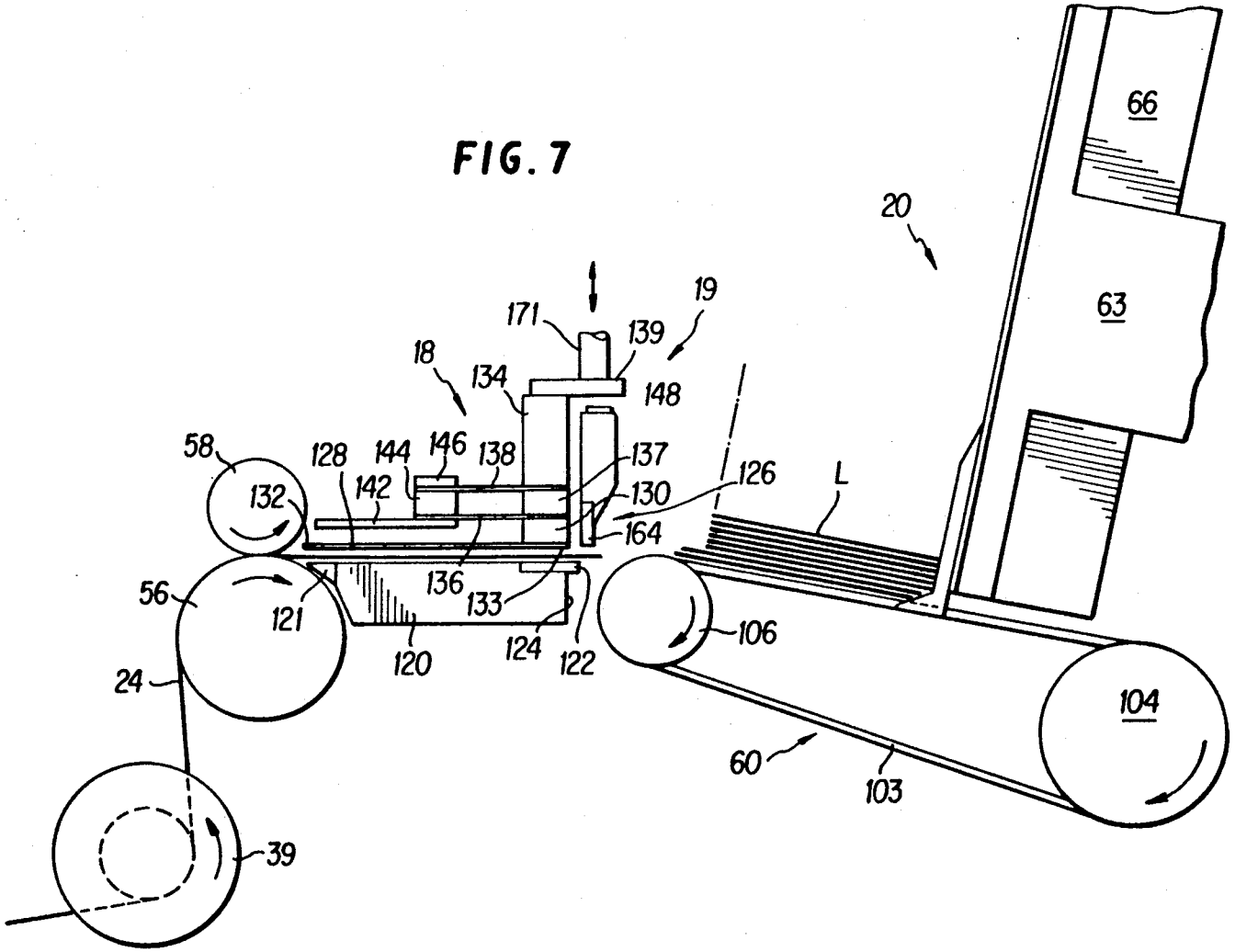
FIG. 7 is a schematic sectional side view of the apparatus depicted in FIG. 3 prior to cutting the web.

With reference to FIGS. 3 through 5, 7 and 8, operation of the accumulator and cutting assemblies 18 and 19 will now be described. The fabric tape 24 is driven by drive roller 56 to the accumulator assembly 18. With particular reference to FIGS. 4, 5 and 7, the cutter arm bias system 172 biases the cutter arm 148 in the manner described above toward an upper position away from the accumulator support base, as depicted in FIG. 7. The spring force exerted by the springs 181 of the bias system against the drive pin 184 is sufficiently great so as to overcome the downwardly-directed spring force exerted against the solenoid shaft 189 and rod assembly 171 associated therewith by the solenoid spring system 192, thereby resulting in upward pivoting or rotational displacement of the cutter arm 148 with respect to the cutter arm mounting shaft 150 so as to bring the actuator seat plate 168 into engagement with the end 196 of the rod assembly shaft 194. Rotational displacement of the cutter arm 148 in this manner also brings the bump screw 166 mounted thereon into engagement with the acoustic damper 140 carried by the lifter post plate 139, thereby urging the lifter post 134 and the associated label spring 128 away from the accumulator support base 120. When the lifter post 134 is in its upper position, the label spring 128 is positioned so as to be generally parallel to the support base 120 and spaced therefrom so as to provide a passage or space through which the fabric tape 24 can be advanced.

Figure 8:
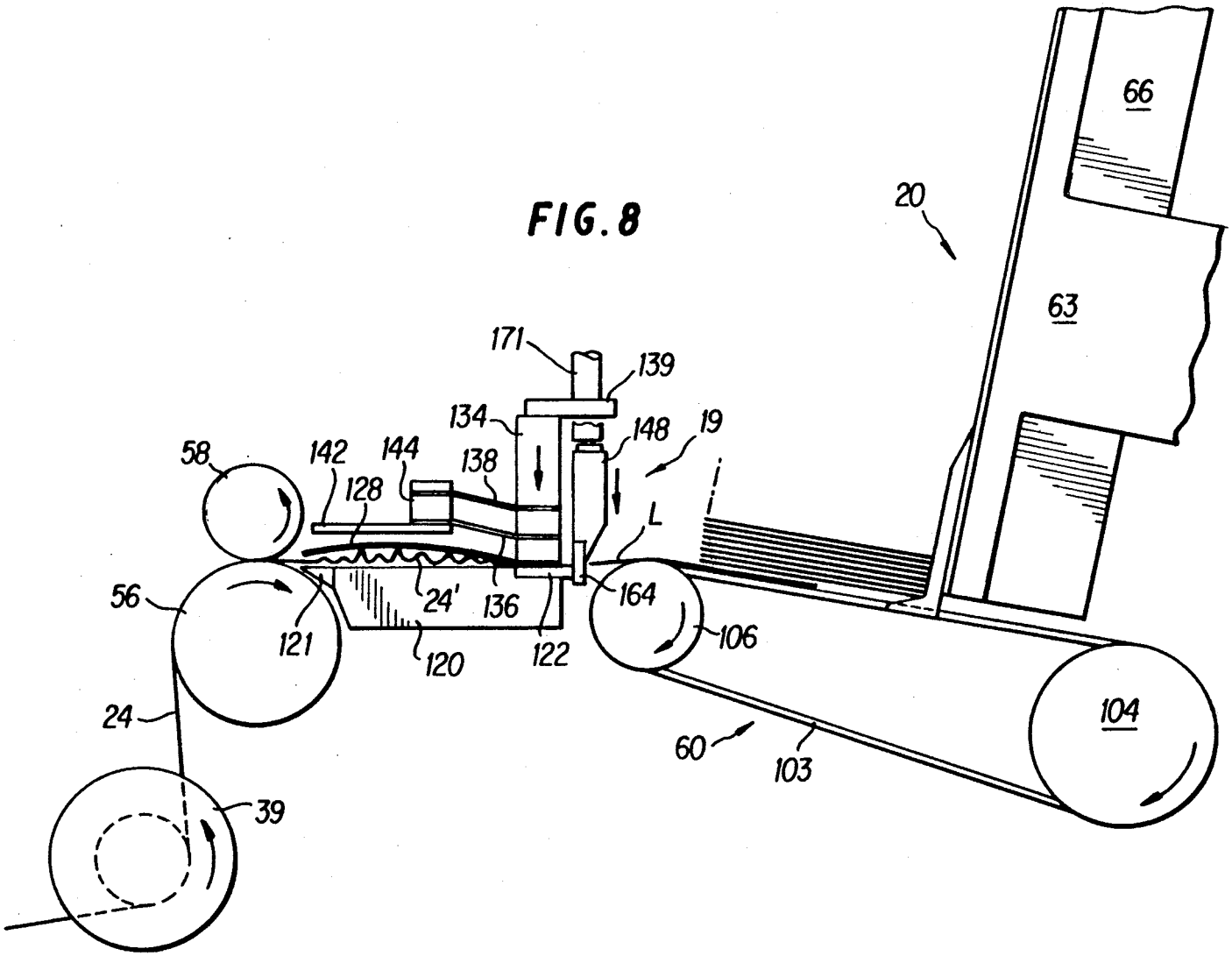
FIG. 8 is a schematic sectional side view of the apparatus depicted in FIG. 3 following cutting of the web.

Upon the receipt of appropriate signal input, such as a positional or registration input from the encoder roll 37 (FIG. 1), the solenoid system 188 is actuated through appropriate control circuitry to effect cutting of the fabric tape into one or more labels L. With particular reference to FIGS. 5 and 8, actuation of the solenoid 190 results in downward displacement of the solenoid shaft 189, thereby urging the rod assembly 171 associated therewith downward and into engagement with the seat plate 168 connected to the cutter arm 148. As the rod assembly 171 is urged further downward by the solenoid shaft 189, the cutter arm is rotatably displaced along the cutter arm mounting shaft 150 downward toward the support base 120. As the cutter arm 148 moves downward, the retentive force exerted by the cutter arm against the lifter post plate 139 is released. Upon the release of the lifter post from the cutter arm, the spring force exerted by the lifter springs 136 and 138 is released, thereby urging the label spring downward with sufficient force to urge the downstream end 133 of the label spring 128 into physical engagement with the fabric tape 24 and thereby halt the flow of tape. Because the tape 24 is continuously fed by drive roller 56 into the space between the label spring 128 and the support base 120, the tape 24 buckles momentarily along its length adjacent to the support base, as shown in FIG. 8. The buckled segment of tape, denoted by reference numeral 24' in the drawing, develops a force directed against both the support base 120 and the label spring 128 that is sufficient to displace the label spring upward and away from the support base 120. The hold-down plate 142 resists deformation of the upstream end of the label spring by the accumulated portion of tape 24 beyond a predetermined extent. After the tape flow has been halted by the label spring, the cutter arm 148 is further rotatably displaced downwardly by the solenoid shaft 189 and its associated rod assembly 171 so as to bring the upper cutting blade 164 into scissor cutting engagement with the portion of the tape 24 that is adjacent to the lower blade 122 so as to sever the tape 24, thereby forming an individual label L.

Once the label L has been cut, it is engaged by the portion of the conveyor belt 103 extending around belt idler 106 and accelerated downstream to the stacker assembly 20 for further processing thereby. Following label cutting, the solenoid system 188 is deactuated, thereby resulting in upward rotational displacement of the cutter arm 148 from the accumulator support base 120 as a result of the spring force exerted by the biasing system 172. As the cutter arm 148 is retracted, the head of the bump screw 166 carried thereby impacts against the shock damper 140 carried by the arm 139 of the lifter post 134 and urges the lifter past away from the support base 120. Upward displacement of the lifter post 134 in this manner releases the downstream or braking end 133 of the label spring 128, thereby removing the force which caused buckling of the tape within the accumulator assembly 18, as depicted in FIG. 8. Release of the potential energy stored in the buckled tape portion 24', in combination with the bias of the label spring toward the support base 120 at the upstream end thereof accelerates the fabric tape portion 24' in a downstream direction toward the cutting assembly 19, after which the foregoing cycle of solenoid system actuation and de-actuation can be repeated to produce a desired quantity of cut fabric labels.

With reference once again to FIGS. 3 and 8, the subject invention further comprises a stacker assembly 20 for orderly stacking articles such as labels L that have been cut by the cutting assembly 19 of the printer 10. The belt conveyor 60 that is provided for delivering articles to the stacker assembly can be comprised of a conventional endless belt 103 having a plurality of upwardly-extending ridges or ribs and which extends across substantially the entire width of the conveyor rollers 104 and 106, or can preferably be configured as a plurality of individual o-ring belts 103' (FIG. 3) that are arranged parallel to one another that are received within correspondingly-dimensioned grooves 260 formed in each of the rollers 104 and 106. The conveyor is preferably angled with respect to two mutually perpendicular reference axes rearwardly with respect to the vertical plane defined by the front end 69 of the machine housing 70 and backwardly with respect to the vertical plane extending across the upstream end of the belt 103', away from the direction of article travel along the belts 103' so as to position the articles such as labels L carried thereby in an optimal orientation for processing by the stacker assembly 20.

Figure 9:
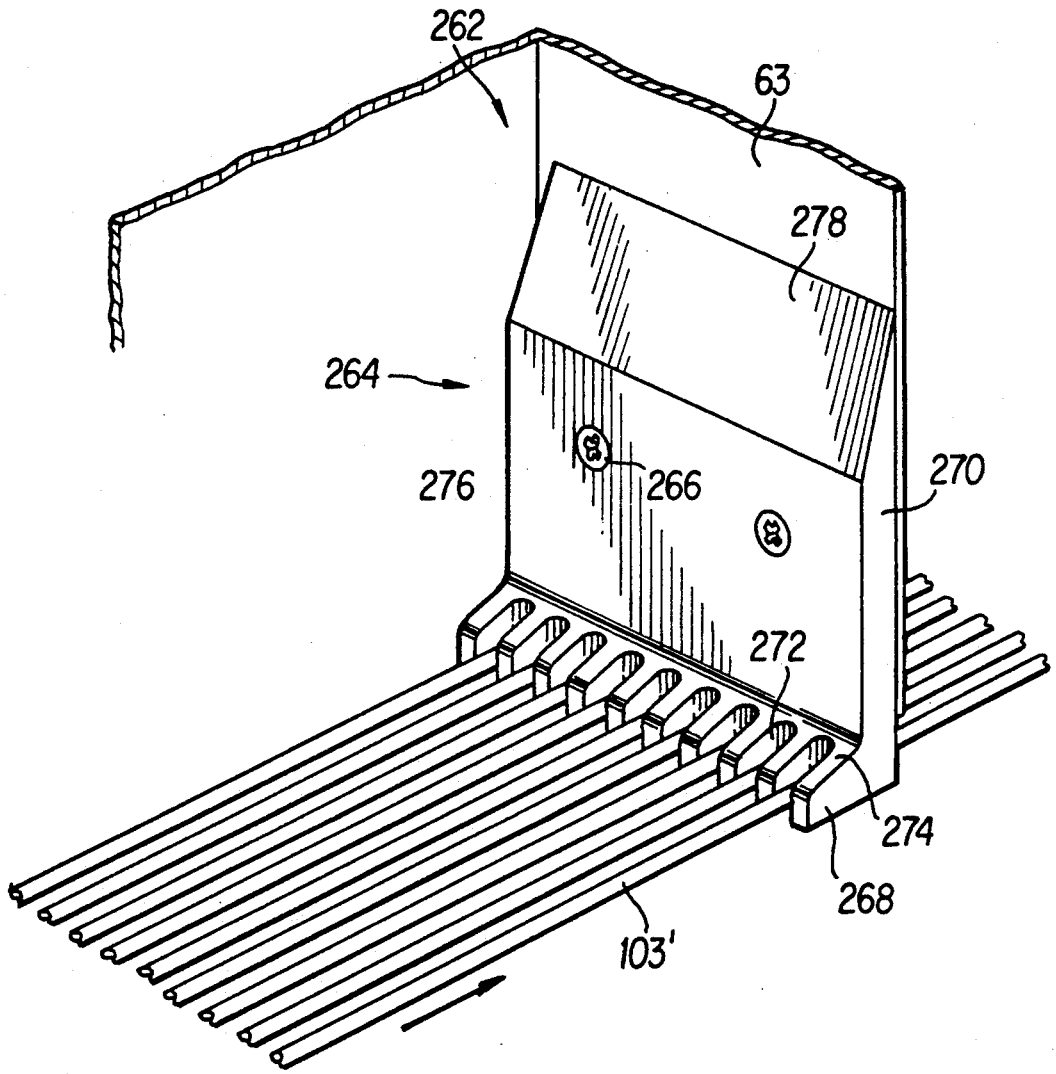
FIG. 9 is a perspective view of a label stop for use with the stacking apparatus of the subject invention.

A stacker chute 262 (FIG. 9) for receiving the articles is defined by the space between the guide plate 63 and the cover plate 66. As it is desirable to feed articles to be stacked within the chute 262 from a lower end thereof, thereby permitting for the ready and safe removal from the chute of previously stacked articles, the chute is preferably provided at its lower end with a stop plate 264 to provide for the orderly, sequential delivery of articles into the stacker chute 262. The stop plate 264 is detachably affixed in a conventional manner, as by threaded fasteners 266, to a lower end of the guide plate 63. Provision of the stop plate is particularly desirable when substantially thin, flat objects such as fabric labels are to be stacked within the chute 262. With reference to FIG. 9, the stop plate 264 is provided with a generally L-shaped cross-sectional configuration and includes a front leg 268 that is inclined rearwardly and upwardly toward a back leg 270. The front leg 268 is provided with a plurality of slots 272 formed therein that are dimensioned to allow passage of a single one of the o-ring belts 103'. The front leg 268 is preferably inclined from about 7° to about 9° away from the belts 103' to provide for a smooth transition from the belts 103' to the back leg 270 of the stop plate. The upper, work surface 274 of the front leg 268 is provided with a smooth finish to permit sliding engagement of a leading edge of the article to be stacked as the article is carried by the belts 103' into the stacker chute 262. The front leg work surface 274 is continuous with the work surface 276 of the back leg 270. The back leg work surface 276 is provided with a smooth finish and is angled toward the guide plate along an upper end 278 thereof to facilitate transfer of the articles thereto that are received by the stop plate. As the conveyor 103' continues to deliver articles such as the labels L cut from the continuous reel of tape 24, the labels are stacked within the stacker chute and are advanced therein away from the belt conveyor 60, thereby permitting for the removal of labels from the chute 262 from a position therein of relative safety that becomes increasingly remote from the conveyor 60 as time progresses. A label marker in the form of an elongated piece of cut label tape 24 can be provided every "n"th label or to differentiate between successive batches of labels in accordance with appropriate program control input to the cutter station 19.

The length of the stacker chute 262 can be adjusted to receive labels of various lengths. Stacker chute adjustment is accomplished by loosening knob 64 so as to permit relative movement of the guide plate 63 relative to the chute back plate 66. English and metric system linear scales 280 and 282 can be provided along the guide plate to permit for the setting of a chute length of prescribed dimensions.

Although the present invention has been described with reference to a preferred embodiment, the invention is not to be construed as being limited to the details thereof. Various modifications and substitutions will be apparent to those of ordinary skill in the art, and all such modifications and substitutions are intended to fall within the spirit and scope of the invention as defined in the appended claims.

What is claimed is:

1. A stacking device for receiving a plurality of generally flexible pieces which have been cut from a web of elongate material, the device comprising:

a stacking chute for receiving the web pieces following their cutting from the material web;

a conveyor for transporting the web pieces to the bottom of the stacking chute; and a label stop positioned at the bottom of the stacking chute, said label stop comprising first and second legs connected to one another so as to provide the label stop with a generally L-shaped configuration, with said first leg being angularly inclined toward the top of the stacking chute, said label stop being operable to support a plurality of generally flexible web pieces in said stacking chute;

and further wherein said stacking device is operable to receive and stack said plurality of generally flexible web pieces in the absence of any auxiliary web piece lifting apparatus.

2. The stacking device of claim 1, wherein said conveyor comprises a plurality of parallel mounted o-ring belts and said angularly inclined label stop leg is provided with a plurality of slots through which said o-ring belts pass.

3. The stacking device of claim 1, wherein said stacking chute comprises a back plate and a guide plate, said guide plate being adjustably mounted to said back plate to accommodate web pieces of different sizes, and wherein said label stop is mounted to said guide plate.

4. A stacking device for receiving a plurality of generally flexible pieces which have been cut from a web of elongate material, the device comprising:

a stacking chute for receiving the web pieces following their cutting from the material web, said stacking chute comprising a guide plate adjustably mounted to a chute back plate;

a label stop mounted to said guide plate;

a conveyor belt for transporting the web pieces to the stacking chute; and a mounting plate to which said conveyor belt and said stacking chute are mounted, said stacking chute being angled with respect to two of three mutually perpendicular reference axes, wherein said label stop is mounted at one end of said guide plate, said label stop comprising first and second legs connected to one another so as to provide the label stop with a generally L-shaped cross-sectional configuration with the first leg being angularly inclined toward a free end of the guide plate, said label stop being operable to support a plurality of generally flexible web pieces in said stacking chute;

and further wherein said stacking device is operable to receive and stack said plurality of generally flexible web pieces in the absence of any auxiliary web piece lifting apparatus.

5. The stacking device according to claim 4, wherein said conveyor belt is inclined downwardly from a receiving end thereof toward a delivery end thereof adjacent said stacking chute.

6. The stacking device according to claim 4, wherein said web pieces are delivered to a bottom portion of the stacking chute so as to be inserted therein beneath the immediately preceding web piece.

7. The stacking device according to claim 4, wherein said conveyor belt comprises a plurality of parallel mounted o-ring belts and said angularly inclined label stop leg is provided with a plurality of slots through which said o-ring belts are rotatably driven.

8. The stacking device according to claim 4, wherein at least one of said guide plate and chute back plate is provided with indicator means for enabling relative positioning of said guide plate and said chute back plate to receive web pieces of a predetermined size.

9. The stacking device according to claim 8, wherein said indicator means is visually perceptible by a user and comprises at least one of metric and English linear measurement scales.

10. The stacking device according to claim 4, further comprising sensor means for terminating delivery of web pieces to said stacking chute when the level of web pieces received within the stacking chute has reached a predetermined stacking chute position.

11. The stacking device according to claim 10, wherein said sensor means is adjustably positioned along said stacking chute.

12. The stacking device according to claim 4, wherein said stacking chute is angled away from a front plane of the stacking device and rearwardly and away from the conveyor belt.

* * * * *